United States Patent [19]

Evans et al.

[11] 4,441,559

[45] Apr. 10, 1984

[54] RETRIEVABLE WELL PACKER

[75] Inventors: Robert W. Evans; James W. Montgomery, both of Huntsville, Tex.

[73] Assignee: Hughes Tool Company, Houston, Tex.

[21] Appl. No.: 442,481

[22] Filed: Nov. 17, 1982

[51] Int. Cl.[3] ..... E21B 33/128; E21B 33/129

[52] U.S. Cl. ..... 166/382; 166/120; 166/217; 166/387; 166/212

[58] Field of Search ..... 166/382, 120, 122, 123, 166/124, 125, 134, 212, 217, 387

[56] References Cited

U.S. PATENT DOCUMENTS

| | | | |
|---|---|---|---|
| 3,282,342 | 11/1966 | Mott | 166/120 |
| 3,361,209 | 1/1968 | Edwards, Jr. | 166/134 |
| 4,190,107 | 2/1980 | Oden et al. | 166/120 |
| 4,289,202 | 9/1981 | Henderson | 166/125 |

*Primary Examiner*—Ernest R. Purser
*Assistant Examiner*—Hoang C. Dang
*Attorney, Agent, or Firm*—Robert A. Felsman; Charles D. Gunter, Jr.

[57] ABSTRACT

A retrievable well packer is shown of the type adapted for releasable setting within a well conduit. The packer has a central mandrel extending within an outer assembly, seal members carried on the outer assembly for sealingly engaging the conduit, anchoring slips carried on the outer assembly for grippingly engaging the conduit, and a hold down piston-collet assembly for releasably connecting the mandrel to the outer assembly to maintain sealing and gripping engagement between the seal members an anchoring slips and the conduit. The collet is movable between a locking position in contact with the piston whereby the mandrel is connected to the outer assembly, and a release configuration out of contact with the piston whereby the mandrel is released for longitudinal movement relative to the outer assembly. A shear wire fixes the piston in the locking configuration in contact with the collet. The shear wire has a preselected shear index, whereby a predetermined increase in well annulus pressure over pressure inside the central mandrel shears the shear wire to release the hold down piston.

9 Claims, 8 Drawing Figures

RETRIEVABLE WELL PACKER

BACKGROUND OF THE INVENTION

The present invention relates generally to retrievable well packers for sealing a tubing string, for example, to a surrounding well conduit such as is provided by a casing or well liner, and, specifically, to a holding mechanism for preventing premature release of the packer from sealing and anchoring engagement in the well conduit.

Well packers are shown in the prior art which are set by manipulation of a tubing string from which the tools are suspended, or by application of hydraulic pressure by means of the tubing string to the tool. Anchoring devices used with such tools commonly include a plurality of slip members with opposed camming surfaces which cooperate with complimentary opposed frustoconical wedging surfaces, whereby the slip members are extended radially into gripping engagement with the well conduit in response to relative axial movement of the wedging surfaces. Sealing devices are known which include annular resilient seal members which expand radially into sealing engagement with the well conduit as the sealing members are axially compressed by the setting mechanism of the tool. The packers are set, rendering the sealing mechanism and the anchoring mechanism in appropriate engagement with the surrounding well conduit in response to relative longitudinal movement of the various packer components, effected either hydraulically or mechanically.

It is critical that the well packer remain locked in its set configuration in spite of variation of well pressures and temperatures and/or manipulation of the tubing string. Various prior packer designs allow the packer to be retrieved from the well bore by appropriate manipulation of the tubing string. In some instances, the packer was released from its set configuration by a straight pull upwardly on the tubing string. Because premature release could result from unwanted longitudinal movement of the tubing string in such designs, pressure-responsive clamping or holding devices were utilized to prevent unwanted movement. Such longitudinal tubing string movement could occur, for example, in response to a variation in tubing string length due to temperature variations, or an increase in down-hole fluid pressure acting upwardly on the tubing string.

There exists a need, therefore, for a retrievable well packer employing pressure responsive clamping or holding devices for preventing unwanted longitudinal movement of the packer components and tubing string which might otherwise release the packer prematurely.

There exists a need for such a retrievable packer featuring a clamping or holding device which is resistant to both an increase in down-hole fluid pressure acting upwardly on the tubing string and to the variation in tubing string length due to temperature variations.

There exists a need for such a packer which can conveniently be released by increasing the annulus pressure above a predetermined reference index point to thereby release the holding device to allow the packer to be retrieved by a straight pull on the tubing string.

SUMMARY OF THE INVENTION

The retrievable well packer of the present invention is adapted to be releasably set within a well conduit. The packer has a central mandrel extending within an outer assembly. Seal means carried on the packer outer assembly are movable between a retracted configuration and an extended configuration in which the seal means sealingly engage the well conduit. Anchoring means carried on the outer assembly are movable between a retracted position and an extended position for grippingly engaging the well conduit.

Holding means releasably connect the mandrel to the outer assembly to maintain sealing and gripping engagement between the seal means and anchoring means and the surrounding well conduit. The holding means includes a piston-collet assembly. The collet is movable between a locking position in contact with the piston whereby the mandrel is connected to the outer assembly, and a release configuration out of contact with the piston whereby the mandrel is released for longitudinal movement relative to the outer assembly.

Shear means are provided for fixing the piston in the locking configuration in contact with the collet. The shear means has a preselected shear index whereby a predetermined increase in well annulus pressure over the pressure inside the central mandrel shears the shear means to release the piston.

Preferably, the outer assembly is spaced-apart from the central mandrel to define an annular pressure chamber therebetween, the outer assembly having a retaining groove formed in the interior thereof. The collet preferably includes a cylindrical collet body and a plurality of depending collet fingers, each of the fingers having a latching dog mounted thereon adapted to be received within the outer assembly retaining groove.

The holding piston is preferably slidably mounted within the annular pressure chamber for movement along the longitudinal axis of the mandrel. The piston has a cylindrical body portion, a cylindrical nose portion of lesser relative diameter than the body portion, and a slanting external sidewall connecting the nose portion and the body portion.

Each of the latching dogs of the collet has a nose portion engaging region for contacting the piston nose portion when the piston is in the locking configuration whereby forces acting on the collet tending to move the latching dogs out of the retaining groove act through the nose region on the piston nose portion to exert only radial force on the piston.

Additional objects, features and advantages will be apparent in the written description which follows.

DETAILED DESCRIPTION OF THE INVENTION

Figure 1A:
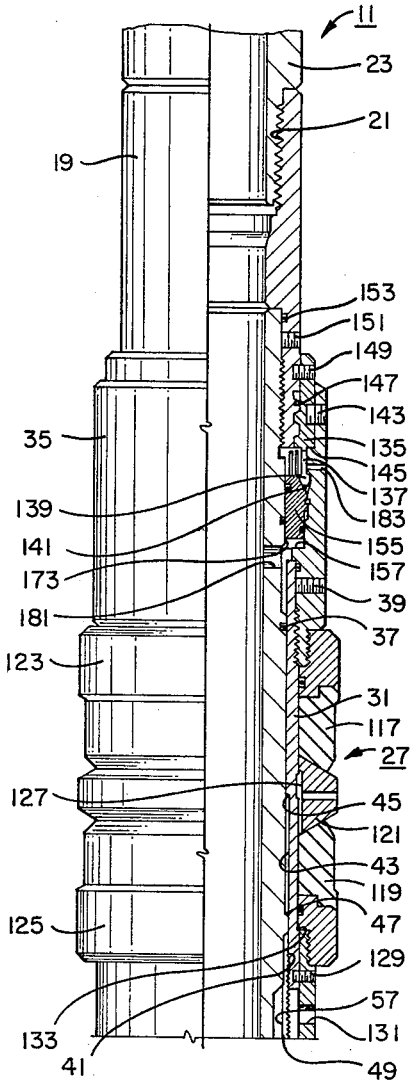
FIG. 1A is a quarter sectional view of a well packer of the invention showing the upper portion of the apparatus in condition to be run into a well conduit.
Figure 1B:
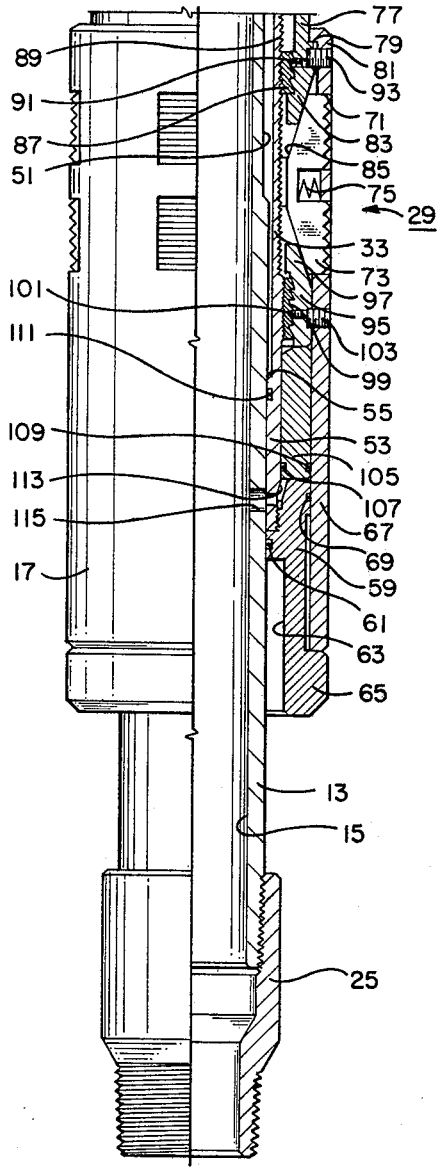
FIG. 1B is a downward continuation of FIG. 1A showing a quarter sectional view of the lower portion of the tool.

A well packer of the present invention is shown generally as 11 in FIGS. 1A and 1B combined. The packer 11 includes a central, tubular mandrel 13 having a generally cylindrical central passage 15. The mandrel 13 is circumscribed by an outer assembly 17 of the packer 11 and is connected thereto by means of a collar 19 as will be presently described. Collar 19 has an internally threaded surface 21 which matingly engages the externally threaded surface of a tubing string 23. The tubing string 23 can be a well production string, for example, which can be continued below the packer by means of additional tubing elements extending downwardly from the bottom of the mandrel 13. A landing collar 25 is threadedly connected to the bottom of the mandrel 13 and is adapted to support additional elements of the tubing string below the packer. The central passage 15 of the mandrel 12 as well as that of the collar 19, is concentric with and forms a continuation of the tubular bore of the tubing string 23.

The outer packer assembly 17 includes a seal assembly 27 and an anchoring assembly 29 which are both radially extendable outwardly to engage a surrounding well conduit. The outer assembly 17 also includes a sleeve system comprising an upper sleeve member 31 and a lower sleeve member 33. The upper sleeve member 31 is sealed to a connector housing 35 by an O-ring 37 and is anchored to the housing by a threaded connection that is locked by a set screw 39. The bottom of the upper sleeve 31 is threadedly connected to the top of the lower sleeve 33 at a threaded connection 41. The threaded connection 41 is constructed of coarse threads on the sleeve member 31, 33 with the lower sleeve member 33 positioned internally of the upper sleeve member 31 and defining the lower limit of a recess 43 formed by undercutting the internal surface of the upper sleeve member 31. The upper limit of the recess 43 is defined by an annular shoulder 45 on the upper sleeve member 31. An annular flange 47 of the mandrel 13 is confined within the recess 43 as shown in FIG. 1A. Above the shoulder 45, the upper sleeve member 31 fits relatively closely against the outer surface of the mandrel 13. Similarly, below the shoulder 45, the upper end of the lower sleeve member 33 fits relatively closely against the outer surface of the mandrel 13 of the configuration of FIGS. 1A and 1B.

The lower sleeve member 33 is constructed in the form of a collet assembly, with the upper portion of the sleeve member comprising upwardly extending collet fingers 49. The threaded connection 41 between the sleeve members 31, 33 is located at the upper end of the collet fingers 49. The mandrel 13 features an annular recess 51 beginning a short distance below the shoulder 45 and extending downwardly. In the configuration shown in FIGS. 1A and 1B, the recess 51 is positioned below the location of the connection 41. The radial depth of the recess 51 is sufficient so that, when the recess 51 is in registration with the connection 41, the collet fingers 49 can be strained radially inwardly into the recess 51 to permit the threaded connection 41 to disengage. However, with the threaded connection 41 positioned above the recess 51, as shown in FIGS. 1A and 1B, the collet fingers 49 are held by the mandrel 13 against inward radial movement, and the connection 41 between the sleeve members 31, 33 remains intact.

The lower end of the second or lower sleeve member 33 extends inwardly to establish a length of the sleeve 53 of reduced internal diameter that fits relatively closely against the mandrel 13, defined at its upper limit by an annular shoulder 55. As a result, an elongated annular region 57 of varying thickness is created between the mandrel 13 and the lower sleeve member 33, which, as will be described, vary with the configuration of the packer 11.

The lower sleeve member 33 is threadedly connected to a retaining skirt 59, which is sealed to the mandrel 13 by an O-ring 61. The retaining skirt 59 features an annular undercut region 63 and an outwardly extending shoulder 65. A generally tubular slip cage 67 rests on the shoulder 65 in the configuration of FIG. 1B. The shoulder 65 thus serves to support the slip cage 67 as the packer 11 is run in a well to guard against blows to the slip cage 67 which might tend to inadvertently set the packer. The retaining skirt 59 is sealed to the internal surface of the slip cage 67 by an O-ring 69.

The slip cage 67 is provided with windows 71 which accommodate a plurality of slip members 73 of the slip assembly 29. Preferably, four slip members are provided as a part of the packer 11. Each of the slip members 73 features upper and lower gripping surfaces positioned to extend radially through individual windows 71 in the slip cage 67. Two windows are provided axially displaced for each slip member 73 with the walls of the slip cage 67 between the pair of windows 71 serving to confine a coil spring 75 which resides in a recess of the slip member 73. The coil springs 75 bias the slip members 73 radially inwardly relative to the wall of the slip cage 67, and serve to maintain the gripping surfaces of the slips retracted in the absence of force tending to propel the slip members 73 radially outwardly.

An upper tubular spreader cone assembly 77 extends downwardly into the top of the slip cage 67 and features an annular shoulder 79 which fits under an inwardly directed flange 81 of the slip cage 67, the two shoulders 77 and 79 defining the limit of axial movement of the cone assembly upwardly relative to the slip cage 67. A downwardly facing, frusto-conical wedging surface 83 of the cone assembly is generally complimentary to the upwardly facing slanted cam surface 85 of the slip members 73.

A split ring locking slip 87 is positioned internally of the cone assembly and connected thereto by coarse, downwardly facing buttress threads on the ring slip which mesh with matching upwardly facing buttress threads on the cone assembly. The exterior surface of the lower sleeve member 33, including the collet fingers 49 below the threaded connection 41, features upwardly facing buttress threads 89 whose pitch is relatively small compared to the pitch of the coarse threads connecting the ring 87 with the cone assembly. The interior surface of the ring slip 87 is lined with small pitch, downwardly facing buttress threads to mesh with the threads 89 of the lower sleeve member 33. A set screw 91 extends radially through the cone assembly and resides in an appropriate bore of the ring slip 87 to prevent rotational movement between the ring slip 87 and the cone assembly which might inadvertently disengage these two elements. One or more shear screws 93 releasably anchors the cone assembly to the slip cage 67.

As can be seen in FIGS. 1A and 1B, slip ring 87 fits loosely within the threads of the cone assembly to permit sufficient radial expansion of the ring to allow the ring to ratchet upwardly over the threads 89 of the sleeve member 33 upon axial movement of the ring upward relative to the sleeve. However, due to the orientation of the threads 89 and the matching buttress threads on the internal surface of the ring 87, downward movement of the ring slip 87 relative to the sleeve member 33 is prevented.

A lower spreader cone 95 is positioned within the slip cage 67 and features a wedging surface 97 which is complimentary to the downwardly facing cam surface of the slip member 73. A split ring locking slip 99 is positioned internally of the lower cone 95 and connected thereto by coarse downwardly facing buttress threads on the exterior of the slip ring 99 meshed with upwardly facing buttress threads on the interior surface of the spreader cone 95. A set screw 101 is engaged in a threaded bore in the spreader cone 95 and extends into a bore in the ring slip 99 to prevent rotation of these two elements. One or more shear screws 103 releasably anchor the lower cone 95 to the slip cage 67. The construction and function of ring slip 99 in relation to lower cone 95 is similar to the construction and function of ring slip 87 in relation to the upper cone assembly.

An annular, floating setting piston 105 circumscribes the lower sleeve member 33 and lies within the slip cage 67 between the top of the retaining skirt 59 and the bottom of the lower cone 95. O-rings 107, 109 seal the piston to the sleeve member 33 and the slip cage 67, respectively. An O-ring 111 seals the sleeve member 33 to the mandrel 13. A pressure chamber 113 is thus formed between the piston 105 and the retainer skirt 59 and radially between the slip cage 67 and the lower sleeve member 33. Access to the pressure chamber 113 from the bore 15 of the mandrel 13 is provided through one or more radial ports 115 through the mandrel 13 and lower sleeve member 33.

The seal assembly 27 includes two annular resilient seal members 117, 119 mounted on the upper sleeve member 31 and axially separated by a seal spacer 121. The seal members 117, 119 are positioned axially between an upper seal retainer ring 123 and a lower seal compression ring 125. The spacer 121 is fixed against axial downward movement relative to the sleeve member 31 by a snap ring 127 but may be moved upwardly against the upper seal member 117. The seal retainer ring 123 is threadedly joined to the housing 35 and, thereby, fixed relative to the upper sleeve member 31.

The upper cone assembly 77 is threadedly engaged to the compression ring 125. One or more shear screws 129 releasably anchors the upper cone assembly 77 to the upper sleeve member 31. The upper cone assembly 77 also features one or more radial ports 131 to allow fluid flow to facilitate movement of the packer 11 along a conduit filled with well fluid. An annular shoulder 133 on the upper sleeve member 31 extends radially below the compression ring 125 and raises the ring 125 and other components of the outer assembly supported thereby in the packer release configuration as will be more fully described.

The housing 35 partially encloses, and forms a part of, a hold down system for releasably anchoring the mandrel 13 to the outer assembly 17 and which includes an anchoring collet assembly 135 featuring downwardly extending collet fingers 137. Each collet finger 137 ends in an enlarged dog or latch 139 which in the relaxed state of the collet fingers 137 resides in an annular groove 141 of the housing 35. The collet assembly 135 is releasably locked to the housing 35 by a shear screw 143. Complimentary shoulders of the collet assembly 135 and the housing 35 abut at 145 to prevent upward axial movement of the housing relative to the collet assembly. The collet assembly 135 is threadedly connected to the collar 19 by means of matching, meshed large pitch threads 147 and at least one shear screw 149. The threaded connection between the mandrel 13 and the collar 19 is locked by a set screw 151 and the mandrel is sealed to the collar by an O-ring 153.

Figure 4:
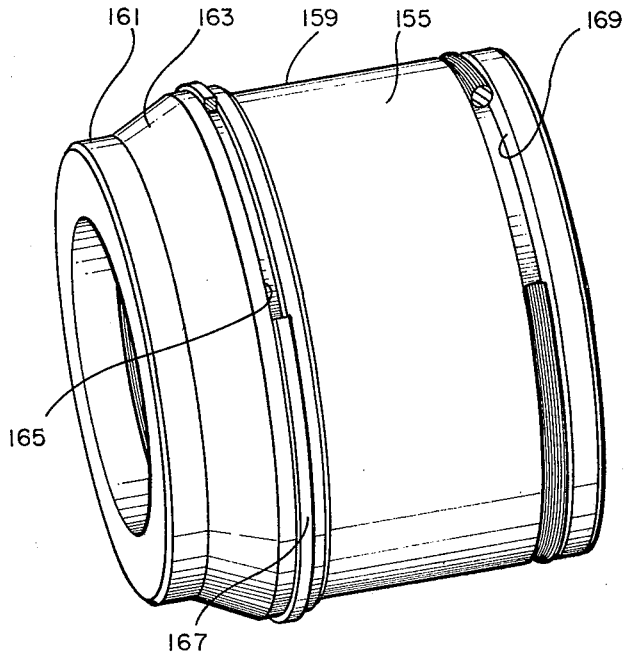
FIG. 4 is a side perspective view of the piston of the invention.

An annular floating piston 155 is confined between the mandrel 13 and the housing 35, and is limited in its downward axial movement by an inwardly extending annular shoulder 157 of the housing. Upward axial movement of the piston 155 relative to the housing 35 is generally limited by the dogs 139 of the collet assembly 135. The shape and position of the floating piston 155 is better understood with reference to FIGS. 4 and 5. The piston 155 has a cylindrical body portion 159 and a cylindrical nose portion 161. The nose portion 161 and body portion 159 are connected by a slanting external sidewall 163. A groove 165 in the piston exterior adjacent sidewall 163 is adapted to receive a square shear wire 167. An O-ring groove 169 is adapted to receive an O-ring for sealing engagement with the housing 35.

Figure 5:
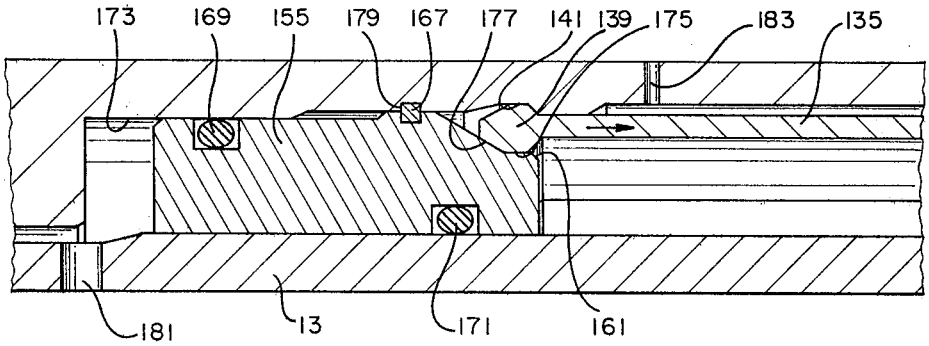
FIG. 5 is a side close-up, cross-sectional view of the piston-collet assembly of the invention.

As shown in FIG. 5, the holding piston 155 is slidably mounted within a pressure chamber 173 for movement along the longitudinal axis of the central mandrel 13. An O-ring 171 provided in an appropriate internal groove seals the piston to the mandrel 13. The latching dogs 139 of the collet assembly 135 each have a nose portion engaging region 175 for contacting the piston nose portion 161 and an angled face 177 for contacting the slanting external sidewall 163 of the piston 155. The piston 155 is initially fixed in a locking configuration by the shear wire 167 received in the groove 165 in the piston and in a complimentary groove 179 in the connector housing 35. In this way, any forces acting on the collet 135 tending to move the latching dogs 139 out of the retaining groove 141 act through the nose portion engaging region 175 of the collet on the piston nose portion 161 to exert only radial forces on the piston 155. The position of the piston 155 with the nose portion 161 bearing against the region 175 and face 177 of the collet dogs 139 residing in groove 141 thus wedges the dogs 139 tightly into the groove. Downward movement of the piston by shearing the shear wire 167 allows the collet 135 to move between a locking position in contact with piston 155 and a release configuration out of contact with piston 155 whereby the mandrel 13 is released for longitudinal movement relative to the outer assembly 17.

The pressure chamber 173 (see FIG. 5) formed by the piston O-rings 169, 171 communicates with the central passage bore 15 of the tool by one or more radial ports 181. Annular pressure is communicated to the opposite side of the piston 155 by means of an outer port 183 in the wall of housing 135. The shear wire 167 can thus be provided with a preselected shear index whereby a predetermined increase in well annulus pressure over the pressure inside the central tool bore 15 shears the shear wire to release the piston 155.

Figure 2A:
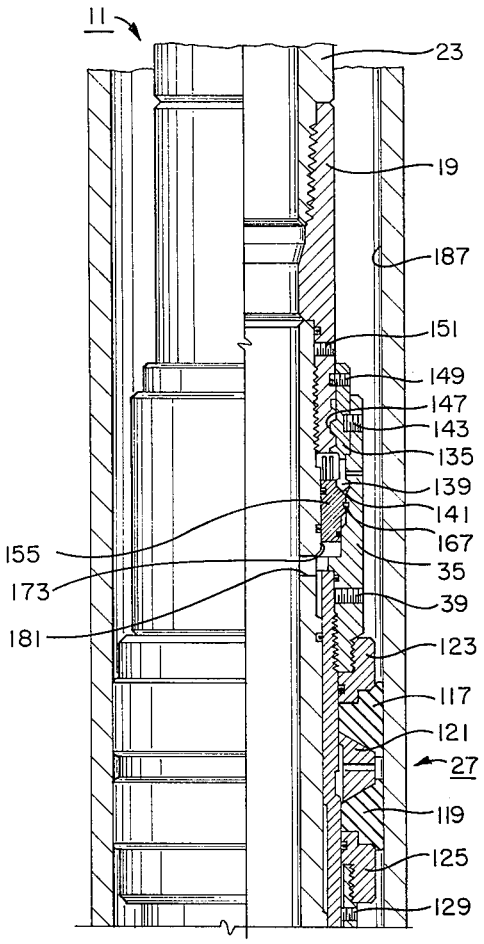
FIG. 2A is a quarter sectional view of the upper portion of the tool showing the tool in sealing engagement with a surrounding well conduit.
Figure 2B:
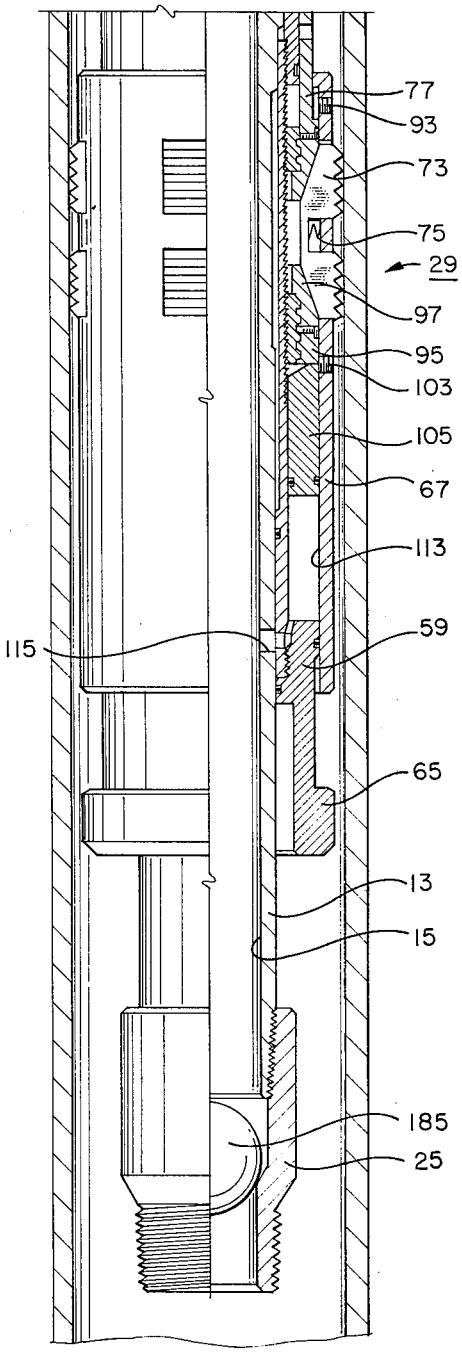
FIG. 2B is a downward continuation of the sectional view of the FIG. 2*a* showing the tool in gripping engagement with the well conduit.

The operation of the present invention will now be described. As shown in FIGS. 2A and 2B, the packer 11 is run to the desired depth in the well bore and a ball 185 is dropped to a landing collar 25 to seal off the tubing bore 15. Fluid pressure in the tubing string is then increased by pumping at the surface to drive the setting piston 105 upwardly against the bottom of the lower cone 95. The forces acting on the piston due to the increased hydraulic pressure in the chamber 113 are transmitted ultimately to the three shear screws 129, 93, and 103. As the fluid pressure is applied to the tubing string, the piston 105 raises the anchoring assembly 29, including the slip cage 67 and the upper cone assembly 77 relative to both sleeve members 31, 33 with the breaking of the shear screw 129. Both ring slips 87 and 99 ratchet upwardly along the sleeve member threads with the respective cones. Upward movement of the cone assembly 77 drives the compression ring 125 upwardly along the upper sleeve member 31 toward the seal retainer ring 123. As a result, seal members 117, 119 are axially compressed and moved toward the retainer ring 123, lifting the spacer 121 off the snap ring 127. As the seal members 117, 119 are compressed axially, they expand radially into engagement with the interior surface of the circumscribing well conduit 187 as shown in FIG. 2A.

The seal assembly 27 is thus locked in sealing engagement with the conduit 187 while the anchoring assembly 29 remains generally in the unset configuration shown in FIG. 1B although the anchoring assembly has moved axially relative to the lower sleeve member 33 and to the mandrel 13 and is locked in this raised configuration by the ring slips 87, 99.

Hydraulic pressure is then increased through the tubing string causing shear screws 93 and, in turn, 103 to be sheared. As shear screw 93 breaks, the slip cage 67 with the slip members 73 held within the windows 71 is driven upwardly relative to the upper slip cone 77. Axial movement of the camming surfaces along the wedging surface 85 of the cone assembly moves the slip members 73 radially outwardly, compressing the coil spring 75, and allowing the slip members to protrude through the windows 71 beyond the radial extent of the slip cage 67. In this manner, the gripping surfaces of the slip members 73 are moved to extend into gripping engagement with the interior surface of the well conduit 187 as shown in FIG. 2B.

The packer is releasable from the fully set condition shown in FIGS. 2A and 2B by upward longitudinal movement of the tubing string 23 and mandrel 13 relative to the outer packer assembly. Such relative longitudinal motion of the tubing string 23 and the mandrel 13 is prevented by the hold down system, and particularly by the latching of the collet dogs 139 in the housing groove 141 and by the shear screw 143 locking the collet assembly 135 to the housing 35, until the hold down system is intentionally released. Similarly, the shear screw 149 is sufficiently strong to prevent inadvertent relative rotational movement between the tubing string 23 and the outer assembly which might otherwise disengage the threaded connection 147 which also secures the packer in the set configuration as a part of the hold down system.

Thus, fluid pressure generated by well fluids, for example, tending to raise the tubing string 23 and the mandrel 13 communicates through mandrel port 181 (see FIGS. 2A and 5) to the pressure chamber 173 thereby holding the piston 155 in locking contact with the dogs 139. The piston is also held in position by shear wire 167.

Another type of stress on the packer is caused by tubing contraction. Tubing contraction occurs, for instance, when cold fluid is pumped down the tubing with the fluid removing heat from the tubing string causing the tubing to contract. As long as the pressure inside the tubing bore 15 is greater than the annulus pressure, the hold down piston 155 keeps the mandrel from moving upwardly. Since the tubing is trying to contract, tensile energy is stored in the tubing string. Once fluid pumping is ceased, only the shear screws 135, 149 keep the mandrel from releasing. In the improved piston design of the invention, the piston nose portion 161 and slanting external sidewall 163 are adapted to contact the dog external regions 177, 175 whereby any force tending to move the collet 135 in the direction of the arrow in FIG. 5 exerts only an axial force on the nose portion 161 of the piston 155. The piston is also fixed and positioned by shear wire 167.

With the piston 155 engaging the collet dogs 139, as shown in FIG. 5, the packer can only be released by rotation, thereby shearing screw 149 (see FIG. 2A) and allowing the coarse threads 147 to disengage. Alternatively, pumping of fluid down the tubing string can be ceased and the annulus pressure can be increased by pumping from the surface. As shown in FIG. 5, the annular pressure communicates through port 183 with the nose portion and slanting external sidewall 161, 163 of the piston 155. When the pressure has been increased sufficiently to overcome the shear index of the shear wire 167, the piston is freed to move out of engagement with the dogs 139.

With the piston 155 disengaged from the collet dogs 139, a straight upward pull on the tubing string 23 without initial rotation of the string severs the shear screw 143 (see FIG. 3A) as the collet assembly 135 is raised relative to housing 35. Such upward movement of the collet assembly 135 causes the collet arms to flex inwardly as the dogs 139 ride out of the housing groove 141. With the dogs 139 free, the tubing string 23 maybe further raised to move the mandrel 13 upwardly relative to the outer packing assembly 17 so that the mandrel shoulder 47 engages the shoulder 45 on the upper sleeve member 31. Continued raising of the mandrel 13 forces the upper sleeve member 31 upwardly. However, the lower sleeve member 33 is locked to the anchoring mechanism 29 by ring slips 87, 99. Consequently, as the mandrel 13 urges the upper sleeve member upwardly, the collet arms 49 flex radially inwardly within the recess 57, allowing disengagement of the threaded connection 41 between the upper sleeve member threads and the lower sleeve member threads.

Figure 3A:
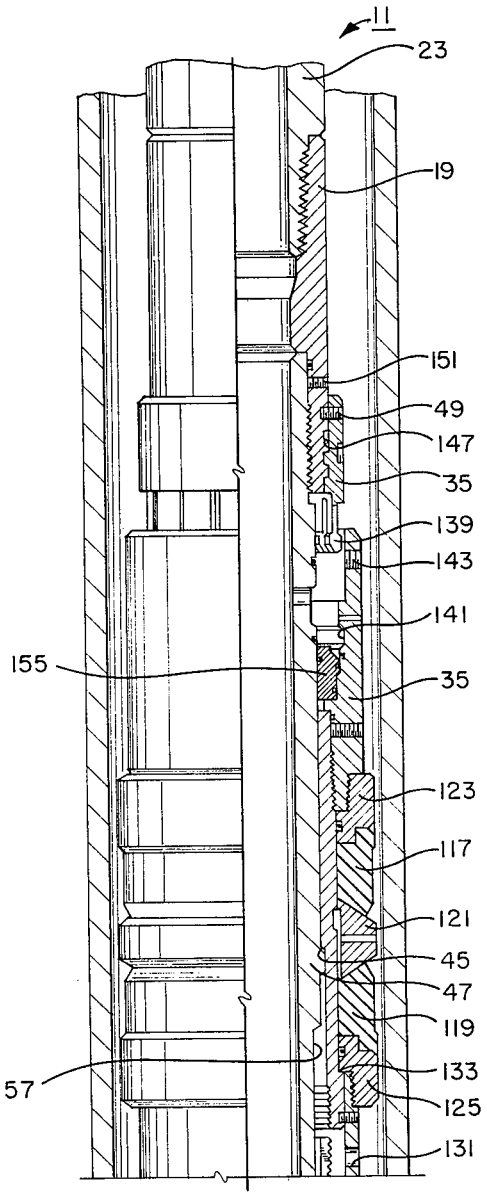
FIG. 3A is a quarter sectional view of the upper portion of the tool showing the release configuration released from sealing engagement with the well conduit.
Figure 3B:
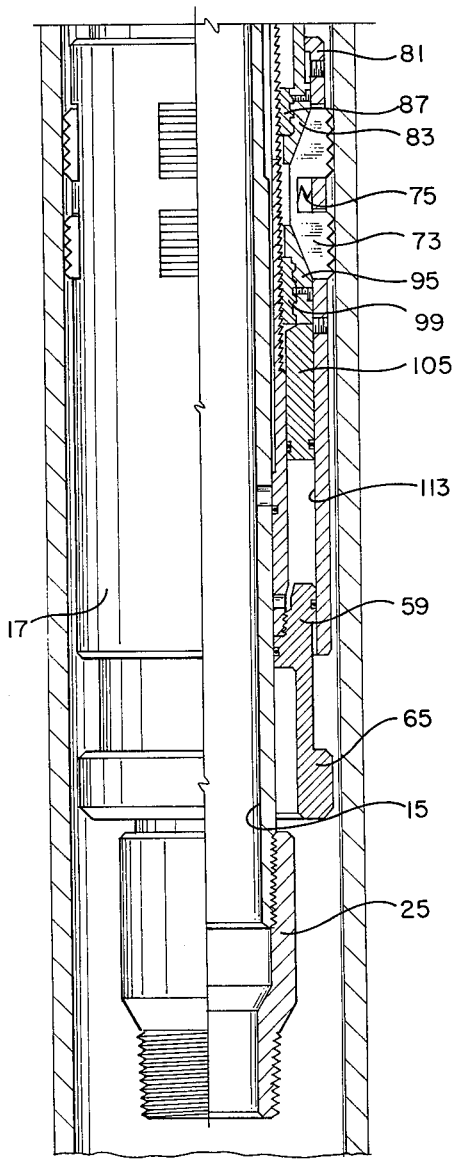
FIG. 3B is a downward continuation of the sectional view of FIG. 3*a* with the lower portion of the tool still in gripping engagement with the well conduit.

As the upper sleeve member 31 is raised, the seal retainer ring 123 is lifted relative to the seal members 117, 119 allowing the seal members to relax and expand axially as shown in FIG. 3A. Continued upward movement of the mandrel 13 raises the shoulder 133 of the upper sleeve member 31 under the compression ring 125. As the compression ring 125 is then raised with the upper sleeve member 31, the upper cone assembly 77 is also raised relative to the lower sleeve member 33 and the slip cage 67. The upward movement of the cone assembly 77 relative to the lower sleeve member 33 causes the ring slip 87 to further ratchet upwardly along the sleeve threads. Further, the upper cone assembly 77 is pulled out from under the slip members 73. With the wedge surface 83 of the upper cone assembly 77 out of engagement with the camming surfaces of the slip members 73, the anchoring assembly is partially unset.

The final phase in the release of the packer is effected by further lifting the tubing string. As the upper cone assembly 77 continues to rise with the upper sleeve member 31 and the mandrel 13, the cone assembly shoulder 79 engages the slip cage shoulder 81 and lifts the slip cage and, therefore, the slip members 73 relative to the lower cone 95. The slip members are thus completely freed of wedging engagement with the well conduit 187 and are retracted radially by expansion of the compressed springs 75. The packer is then completely released from its set configuration in engagement with the conduit 187 and can be withdrawn from the well with the tubing string 23.

An invention has been provided with significant advantages. The retrievable packer of the invention can by hydraulically set in the well bore and features a novel hold down system for preventing inadvertent release of the tool by upward longitudinal movement of the tubing string and mandrel. The hold down system features a novel piston and collet assembly which is not affected by fluid pressures below the packer unit or by tensile forces acting on the collet due to tubing contraction. The packer can be released by either rotation or by increasing the annular pressure sufficiently to overcome the shear index of a shear wire which fixes the hold down piston in the locked configuration.

While the invention has been shown in only one of its forms, it is not thus limited but is susceptible to various changes and modifications without departing from the spirit thereof.

We claim:

1. A retrievable well packer adapted for releasable setting within a well conduit, comprising:

a central mandrel extending within an outer assembly;

seal means carried on said outer assembly and movable between a retracted configuration and an extended configuration in which said seal means sealingly engage said conduit;

anchoring means carried on said outer assembly and movable between a retracted position and an extended position for gripping by engaging said conduit;

holding means for releasably connecting said mandrel to said outer assembly to maintain sealing and gripping engagement between said seal means and anchoring means and said conduit, said holding means including a piston collet assembly, said collet being movable between a locking position in contact with said piston whereby said mandrel is connected to said outer assembly, and a release configuration out of contact with said piston whereby said mandrel is released for longitudinal movement relative to said outer assembly;

shear means for fixing said piston in said locking configuration in contact with said collet, said shear means having a preselected shear index whereby a predetermined increase in well annulus pressure over pressure inside said central mandrel shears said shear means to release said piston.

2. The well packer of claim 1, wherein said outer assembly is spaced-apart from said central mandrel to define an annular pressure chamber therebetween, said outer assembly having a retaining groove formed in the interior thereof.

3. The well packer of claim 2, wherein said collet includes a cylindrical collet body and a plurality of depending collet fingers each of said fingers having a latching dog mounted thereon adapted to be received within said outer assembly retaining groove.

4. The well packer of claim 3, wherein said holding piston is slidably mounted within said annular pressure chamber for movement along the longitudinal axis of said central mandrel, said piston having a cylindrical body portion, a cylindrical nose portion of lesser relative diameter than said body portion, and wherein said nose portion and said body portion are connected by a slanting external sidewall.

5. The well packer of claim 4, wherein each of said latching dogs of said collet has a nose portion engaging region for contacting said piston nose portion when said piston is in said locking configuration whereby forces acting on said collet tending to move said latching dogs out of said retaining groove act through said nose region on said piston nose portion to exert only radial force on said piston.

6. The well packer of claim 5, wherein said shear means is a shear wire received in mating grooves in said piston body portion and said interior of said outer assembly.

7. In a retrievable well packer of the type adapted for releasable setting within a well conduit having a central mandrel extending within an outer assembly, seal means carried on the outer assembly for sealingly engaging the conduit, anchoring means carried on said outer assembly for grippingly engaging said conduit, and holding means for releasably connecting said mandrel to said outer assembly to maintain sealing and gripping engagement between said seal means and anchoring means and said conduit, said holding means including a piston-collet assembly, said collet being movable between a locking position in contact with said piston whereby said mandrel is connected to said outer assembly, and a release configuration out of contact with said piston whereby said mandrel is released for longitudinal movement relative to said outer assembly, the improvement comprising:

shear means for fixing said piston in said locking configuration in contact with said collet, said shear means having a preselected shear index whereby a predetermined increase in well annulus pressure over pressure inside said central mandrel shears said shear means to release said piston.

8. The retrievable well packer of claim 7, whereby said shear means is a shear wire.

9. A method of retrieving a well packer of the type adapted for releasable setting within a well bore, comprising the steps of:

providing said packer with a central mandrel extending within an outer assembly, said outer assembly having seal means for sealingly engaging the well conduit and anchoring means for grippingly engaging the well conduit;

setting said packer in said well bore to sealingly and grippingly engage said well conduit;

providing said packer with holding means for releasably connecting said mandrel to said outer assembly to maintain sealing and gripping engagement between said seal means and anchoring means and said conduit, said holding means including a piston-collet assembly, said collet being movable between a locking position in contact with said piston whereby said mandrel is connected to said outer assembly, and a release configuration out of contact with said piston whereby said mandrel is released for longitudinal movement relative to said outer assembly;

providing shear means for fixing said piston in said locking configuration in contact with said collet, said shear means having a preselected shear index whereby a predetermined increase in well annulus pressure over pressure inside said central mandrel shears said shear means to release said piston;

increasing the annulus pressure to exceed said shear index to shear said shear means and release said piston;

and applying an upward pull to the central mandrel to release said sealing means and, in turn, said anchoring means to release said packer.

* * * * *